United States Patent [19]

Gatewood

[11] 4,093,298

[45] June 6, 1978

[54] COMPRESSOR TONGS

[75] Inventor: Ralph M. Gatewood, Palmersville, Tenn.

[73] Assignee: The Raymond Lee Organization, Inc., New York, N.Y.

[21] Appl. No.: 759,793

[22] Filed: Jan. 17, 1977

[51] Int. Cl.[2] ..... B66C 1/28

[52] U.S. Cl. ..... 294/118

[58] Field of Search ..... 294/118, 115, 106, 67, 294/78, 110, 113, 119; 214/147 G

[56] References Cited

U.S. PATENT DOCUMENTS

| | | | |
|---|---|---|---|
| 851,987 | 4/1907 | Hewitt | 294/118 |
| 3,582,128 | 6/1971 | Martelee | 294/118 |
| 3,778,097 | 12/1973 | Dorzan | 294/118 |

*Primary Examiner*—James B. Marbert

*Attorney, Agent, or Firm*—Howard I. Podell

[57] ABSTRACT

A tong assembly for grasping of a cylindrical body such as an air-conditioner compressor. A pair of cross bars are pivotally joined together by a flexible chain to which a hand grip is fitted and the lower end of each cross bar pivotally mounted to an upper section of a vertical strut. An open jaw shaped to fit externally about a compressor cylinder is pivotally mounted to each strut below the cross-bar joint, and an L-shaped grip is fixed to the bottom section of the vertical strut, shaped to fit about the bottom corner of the gripped compressor cylinder, with the clamp and grip of each strut located to face the opposed strut. Crossed stabilizing bars are pinned to the cross bars and the vertical struts to apply a torque to the struts about the clamps, when gripped about a suspended cylinder to prevent the bottom ends of the struts from rotating apart from each other.

3 Claims, 4 Drawing Figures

COMPRESSOR TONGS

SUMMARY OF THE INVENTION

My invention is a tong assembly for grasping of a cylindrical body such as an air-conditioner compressor. A pair of cross bars are pivotally joined together by a flexible chain to which a hand grip is fitted and the lower end of each cross bar pivotally mounted to a upper section of a vertical strut. An open jaw shaped to fit externally about a compressor cylinder is pivotally mounted to each strut below the cross-bar joint, and an L-shaped grip is fixed to the bottom section of the vertical strut, shaped to fit about the bottom corner of the gripped compressor cylinder, with the clamp and grip of each strut located to face the opposed strut. Crossed stabilizing bars are pinned to the cross bars and the vertical struts to apply a torque to the struts about the clamps, when gripped about a suspended cylinder to prevent the bottom ends of the struts from rotating apart from each other.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
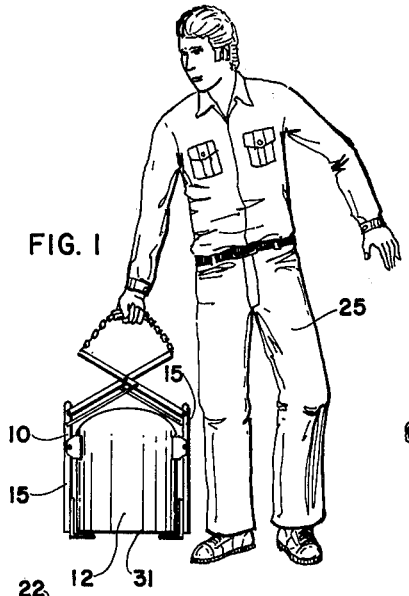
FIG. 1 is a perspective view of the invention in use.
Figure 2:
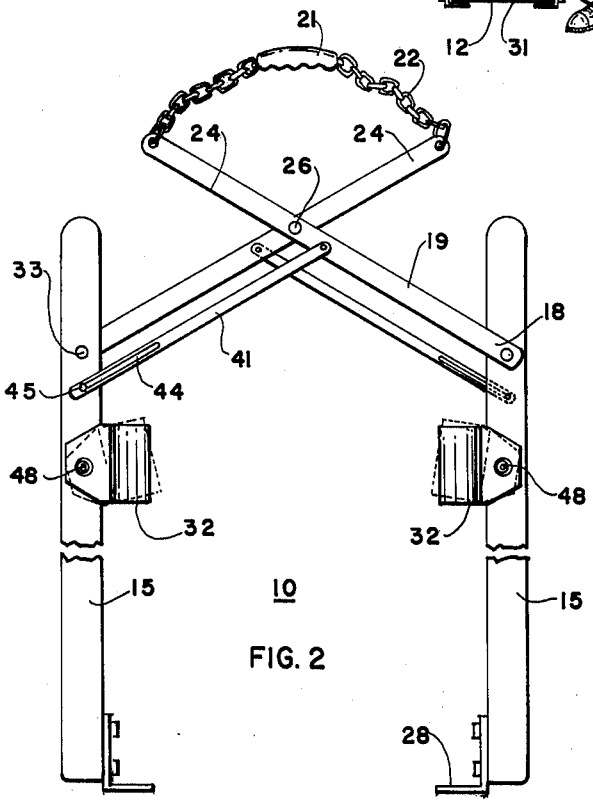
FIG. 2 is a side view of the invention, in the open position.
Figure 3:
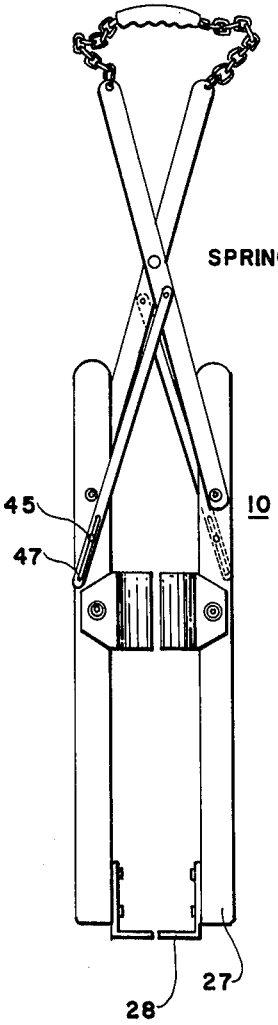
FIG. 3 is a side view of the invention, in the closed position.
Figure 4:
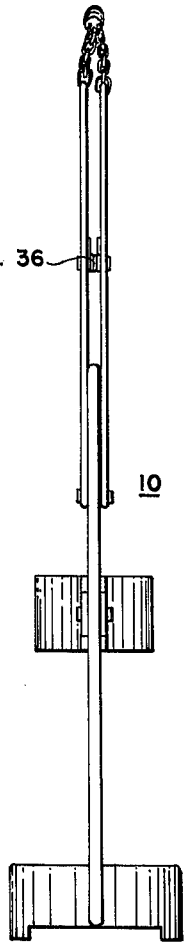
FIG. 4 is an end view of the invention.

Turning now descriptively to the drawings, in which similar reference characters denote similar elements throughout the several views, FIGS. 1–4 illustrate the tong assembly 10 which may be employed to grip and suspend a cylindrical body 11 such as an air-conditioner compressor body 12.

Compressor body 12, when gripped, is clamped between a pair of vertical struts 15 that are each pivotally mounted to the lower end 18 of a cross-bar 19, with cross-bars 19 pivotally joined together by a pin 26 and manually suspended by a grip 21 fastened about a chain 22 joined to each of the upper ends 24 of the cross-bars 19. The user 25 may hold grip 21 with one hand to safely transport the suspended cylindrical body 12.

Each strut 15 is fixed at its lower end 27 to an L-shaped bracket 28 that projects about the bottom corner 31 of a suspended body 12, with a pair of concave clamp jaws 32 pivotally mounted by a pin 48 to each strut 15 between bracket 28 and pin 33 joining the strut to a cross-bar 19.

A torque coil spring 36 is mounted about pin 26 and fixed to rotate cross-bars 19 so as to close struts 15 towards each other.

A stabilizer bar 41 is pivotally mounted by a pin 42 at one end to a first cross-bar 19 and slidably fixed to the vertical strut 15 pinned to the second cross-bar 19, so that both stabilizer bars are in crossed relation, with slot 44 of a length to permit bar 41 to freely slide against pin 45 when the two struts are drawn to the closed position, but with slot 44 of a length so that an end wall 47 of slot 44 bears against pin 45 with the two struts extended apart from each other in parallel configuration and jaws 32 clamped against a compressor body 12 of a specific size. Stabilizer bars 41 prevent rotation of the fastened strut bars 15 about the pin 48 to which jaws 32 are mounted in the opening direction of bar ends 27.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tong assembly for gripping a cylindrical shaped body such as an air-compressor comprising, a pair of vertical struts, a pair of cross bars pivotally mounted together at an intermediate section of each cross bar, with a lower end of each cross bar pivotally mounted to an upper section of one vertical strut, with a clamp bracket fixed to the lower end of each strut of a shape to fit under a corner of a cylindrical object, and with a clamp jaw, of a shape to fit about the curved side of said cylindrical object, pivotally mounted to an intermediate section of each strut, together with tension means fixed to the upper end of each cross-bar, said tension means suitable for suspending the assembly.

2. The combination as recited in claim 1 in which the assembly is fitted with stabilizer means to limit rotation of the two vertical struts about the clamp jaw pivot in the opening direction of the lower ends of the vertical struts when the vertical struts are in parallel configuration and with a cylindrical body of a given size gripped between the clamp jaws.

3. The combination as recited in claim 2 in which the stabilizer means comprise a pair of stabilizer bars each pivoted to one cross-bar and slidably fastened to the strut pivotably mounted to the other cross-bar.

* * * * *